United States Patent [19]

Franssen, deceased et al.

[11] 4,352,954

[45] Oct. 5, 1982

[54] ARTIFICIAL REVERBERATION APPARATUS FOR AUDIO FREQUENCY SIGNALS

[75] Inventors: Nico V. Franssen, deceased, late of Knegsel, Netherlands; by Friedrich J. de Haan, administrator, Dommelen, Netherlands

[73] Assignee: U.S. Philips Corporation, New York, N.Y.

[21] Appl. No.: 155,697

[22] Filed: Jun. 2, 1980

Related U.S. Application Data

[63] Continuation-in-part of Ser. No. 965,360, Nov. 30, 1978, abandoned.

[30] Foreign Application Priority Data

Dec. 29, 1977 [NL] Netherlands ..... 7714502

[51] Int. Cl.[3] ..... H04R 3/00

[52] U.S. Cl. ..... 179/1 J; 84/DIG. 26

[58] Field of Search ..... 179/1 D, 1 J; 330/85, 330/107, 151, 84; 333/138, 143; 84/DIG. 26

[56] References Cited

U.S. PATENT DOCUMENTS

| | | | |
|---|---|---|---|
| 3,110,771 | 11/1963 | Logan, Jr. et al. | 179/1 J |
| 3,881,057 | 4/1975 | Adachi et al. | 179/1 J |
| 3,939,436 | 2/1976 | Keller | 330/151 |
| 3,939,437 | 2/1976 | Adam | 179/1 J |
| 4,053,711 | 10/1977 | Defreitas et al. | 179/1 J |

FOREIGN PATENT DOCUMENTS

| | | | |
|---|---|---|---|
| 52-15248 | 2/1977 | Japan | 333/138 |
| 52-15249 | 2/1977 | Japan | 333/138 |

OTHER PUBLICATIONS

M. R. Schroeder; "Natural Sounding Artificial Reverberation"; J.A.E.S.; Jul. 1962; vol. 10, No. 3; pp. 219–223.

*Primary Examiner*—Bernard Konick
*Assistant Examiner*—Randall P. Myers
*Attorney, Agent, or Firm*—Bernard Franzblau; Robert T. Mayer; Thomas A. Briody

[57] ABSTRACT

An artificial reverberation apparatus for audio frequency signals, comprises a first delay device preceded by an adder. A feedback circuit couples the output of the delay device to an input of the adder to give a loop signal gain of less than unity. The adder is preceded by a second delay device with the same delay time as said first-mentioned delay device. The signal to be delayed is applied to the input of said second delay device and also to the adder via a transmission path. The ratio of the signal gain of the transmission path to the signal gain of said second delay device is equal to but of opposite sign to said loop signal gain. Preferably the signal gain of the transmission path is equal to but of opposite sign to the signal gain of said feedback circuit. Furthermore, a plurality of apparatuses can be connected in cascade with the delay devices of the different apparatuses all having different delays.

8 Claims, 2 Drawing Figures

ARTIFICIAL REVERBERATION APPARATUS FOR AUDIO FREQUENCY SIGNALS

This is a Continuation-in-Part of application Ser. No. 965,360, filed Nov. 30, 1978, now abandoned.

The invention relates to an artificial reverberation apparatus for audio frequency signals comprising a delay device and a feedback circuit which couples the output of the delay device to the input thereof via a signal combining means so as to provide a loop signal gain of less than unity.

Such a device is known from "Natural Sounding Artificial Reverberation" by M. R. Schroeder, J.A.E.S., July 1962, 10, 3, pages 219–223, see FIG. 1.

In the known reverberation apparatus a signal is obtained at the output which corresponds to the input signal to which periodically, i.e. with delays equal to integral multiples of those of the delay apparatus, "echo" signals have been added, which acoustically gives the impression of artificial reverberation.

The principal drawback of the known apparatus is that signals to be processed by the delay apparatus vary substantially in amplitude. If the loop signal gain of the apparatus, being the product of the gain factor of the delay line (in this case equal to one) and the feedback gain factor of the feedback circuit (g), is approximately 1, for example 0.7, a crest-dale ratio of 5.7 (15 dB) is found in the frequency characteristic of the device. This may give rise to undesired non-linearities and in particular, when a charge transfer device such as for example a bucket brigade memory is employed as a delay device, to overdriving of such a charge transfer device. It is an object of the invention to avoid this drawback. The reverberation apparatus according to the invention is characterized in that a second delay device is provided which gives rise to the same time delay as does the first mentioned delay device and which couples an input terminal of the reverberation apparatus to the input of the first mentioned delay device via said signal combining means. The apparatus also includes a transmission path which couples said input terminal to the input of the first mentioned delay device via a current path that is exclusive of said second delay device and via said signal combining means, the ratio of the signal gain of the transmission path to the signal gain of said second delay device being equal to but of opposite sign to that of said loop signal gain. In this way a reverberation apparatus is obtained having a flat frequency characteristic throughout the circuit.

Figure 1:
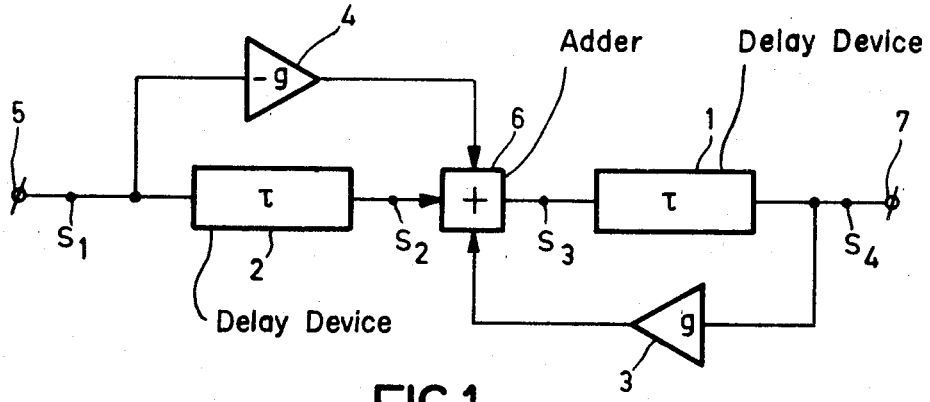
Figure 2:
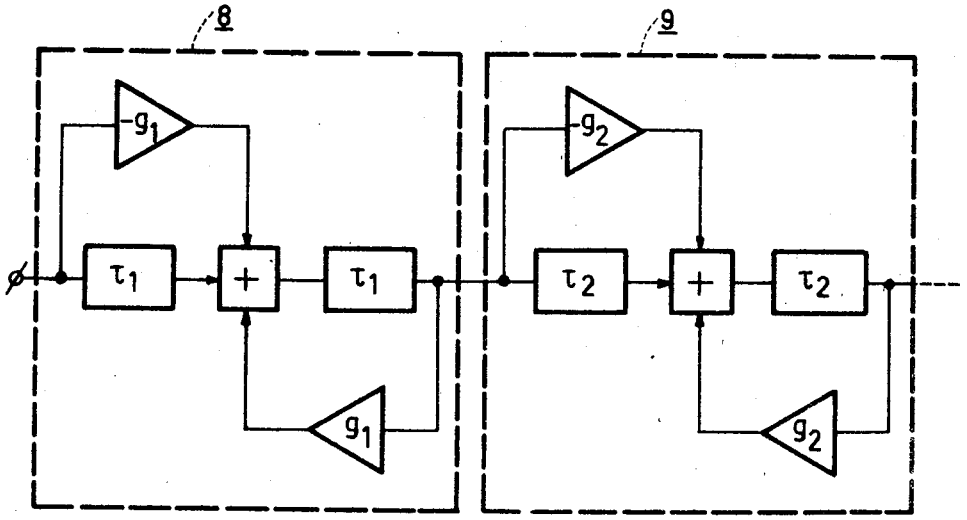

In FIG. 2 of the above mentioned article another apparatus is described that also shows a flat frequency characteristic. This FIG. 2 describes a reverberation apparatus in which the delay device of FIG. 1 is followed by a circuit with a transmission gain factor of $1-g^2$, after which the input signal of the delay device of FIG. 1 is added to the output signal of said circuit with a transmission gain factor of $-g$. The advantage of the reverberation apparatus according to the invention over the known apparatus of FIG. 2 is that the known apparatus has only a flat frequency characteristic externally and not internally, whereas the reverberation apparatus according to the invention has a flat frequency characteristic externally as well as internally.

Another drawback of the apparatus of FIG. 2 of the known apparatus is that transmission paths with different transmission gain factors are required, namely once with a transmission gain factor g or $-g$, the other time with $(1-g^2)$. If said transmission gain factors are to be adjustable, which may be desirable for certain sound systems, these different values of the transmission gain factors demand intricate measures, especially if digital adjustment of these factors is considered.

It is also an object of the invention to aviod the above-mentioned drawback and the invention is characterized in that the signal gain of the transmission path is equal to but of opposite sign to the signal gain of the feedback circuit. Although both reverberation apparatusses according to the invention require the use of a second delay evice (which at the most gives rise to an additional noise of 3 dB) the following advantages are preponderate:

the arrangement is very simple it is extremely suitable for integration each of the delay devices which are used need only process signals with a flat frequency response the drive of the reverberation apparatus is independent of the feedback factor.

Furthermore, the signal gains of both delay devices are preferably made equal to unity. In this way the amplitude of the signal to be processed by the apparatus remains constant throughout the circuit, which makes it possible to maintain a high signal-to-noise ratio in the apparatus.

It is particularly favourable to use a charge transfer device as a delay device. By means of this charge transfer device, which is available for example in the form of an integrated device, such as a "bucket brigade memory", time delays of at least 5 msecs. can be obtained.

In accordance with the invention, a plurality of reverberation apparatuses are connected in cascade with the delays of the delay devices of the different apparatuses all being preferably different.

By means of the series connection of a plurality of reverberation devices in accordance with the invention which are adjusted to different delays, the number of reflections per second during decaying can be increased, which gives the sensation of natural reverberation. These delay times are then preferably in a non-harmonic relationship with each other so that the echos produced coincide to the least possible extent.

The invention will now be described in more detail with reference to the drawing.

FIG. 1 shows an artificial reverberation apparatus in accordance with the invention and FIG. 2 shows two reverberation apparatuses according to the invention connected in cascade.

FIG. 1 schematically represents an artificial reverberation apparatus in accordance with the invention. The apparatus consists of two delay devices 1 and 2 respectively, which are identical and which produce a delay time $\tau$.

The delay devices may consist of clock-pulse controlled charge transfer devices, for example so-called bucket brigade memories, which are commercially available in integrated form under No. TDA 1022 (Philips). If identical charge transfer devices are used, which are connected to the same clock-pulse source, equality of the delay time is guaranteed. The delay time obtained may then be, for example, be 10 msecs.

The delay device 1 is provided with a feedback circuit having a feedback gain factor g of for example, 0.7. The loop signal gain of the loop circuit comprising delay device 1, feedback circuit 3, adder 6 and any other amplifying elements in said loop circuit is less than unity. The loop signal gain is the product of the gain factor of the delay device, the feedback gain factor of the feedback circuit, and the gain factor of any other amplifying elements connected in the loop circuit.

Parallel to the delay device 2 a transmission circuit 4 is connected whose transmission gain factor $(-g)$ is equal but opposite to that of the feedback circuit 3.

Linear operational amplifiers such as for example type No. TDA 1034 (Philips) having an inverting and a non-inverting input are extremely suitable for the circuits 3 and 4.

The input of delay device 1, the output of feedback circuit 3, the output of delay device 2, and the output of transmission circuit 4 are connected to an adder 6.

The signal to be delayed $S_1$—generally an audio frequency signal—is applied to input terminal 5.

At the output of the delay device 2 this signal has become:

$$S_2 = S_1 \cdot e^{-j\omega\tau}$$

Via the transmission path 4 the following signal is added to said signal: $-gS_1$.

The signal which has been combined in the adder $$S_1(e^{-j\omega\tau} - g)$$

is applied to the feedback delay line 1, whose feedback circuit 3 has the same transmission gain factor as that of circuit 4, but of opposite sign. Thus, the signal is multiplied by a factor $$e^{-j\omega\tau}/(1 - g \cdot e^{-\omega\tau})$$

so that:

$$S_4 = S_1 \cdot e^{-j\omega\tau} \cdot \frac{e^{-j\omega\tau} - g}{1 - g \cdot e^{-j\omega\tau}}$$

or $$S_4 = S_1 \cdot e^{-2j\omega\tau} \cdot \frac{1 - g \cdot e^{+j\omega\tau}}{1 - g \cdot e^{-j\omega\tau}} \quad (1)$$

This total signal transmission of the device in accordance with the invention is almost the same as that of the above mentioned known device. However, the principal advantage now is that the signals applied to the delay devices 1 and 2 exhibit a flat frequency response so that non-linear distortions and overdriving of said delay devices can be avoided, while maintaining a high signal-to-noise ratio. For the input signal $S_1$ of delay device 2 this is self-evident. For the input signal $S_3$ of delay device 1 it is found that $$S_3 = S_1 \cdot e^{-j\omega\tau} \cdot \frac{1 - g \cdot e^{+j\omega\tau}}{1 - g \cdot e^{-j\omega\tau}} \quad (2)$$

and this expression is not only identical to the final result of the known apparatus, but moreover the delay device 1 now processes a signal with a flat frequency response because the fraction in the above-mentioned expression has a modulus $= 1$.

At option, the output signal can be taken from the input ($S_3$) or from the output 7 ($S_4$) of the delay device 1.

FIG. 2 shows a series connection of a plurality of artificial reverberation apparatuses 8, 9, . . . as described before. By adjusting the delay devices of the respective apparatuses to different delay times, the effect of a natural reverberation can be simulated more or less. By adjustment of the factor g the decay time of the reverberation effect can then be varied.

Alternatively, there may be provided a multiplicity of transmission paths 3 and 4 in the apparatus in FIG. 1. If the delay devices 1 and 2, for example, take the form of charge transfer devices such as bucket brigades or charge-coupled devices, a plurality of tappings on such a delay device 1 (i.e. each having an individual delay relative to the junction point $S_3$) are each connected to the adder 6 via separate transmission devices 3. On the transmission device 2 corresponding tappings, whose delays relative to the junction point $S_2$ are equal to those of the tappings on the delay device 1 relative to the junction point $S_3$, should then be connected to the adder via separate transmission devices 4 having transmission gain factors which are equal but opposite to those of the transmission devices 3.

In the case of a digital version of the apparatus, this adjustment of the gain factor g will generally be effected by digital means. The transmission circuits 3 and 4 may consist of digital multipliers, as for example used in small pocket calculators. The signals $S_4$ and $S_1$ which are applied in digital form to the inputs of these transmission circuits 3 and 4, which take the form of multipliers, are then multiplied by a fixed factor g and applied to the adder 6. Preferably, this multiplier should be designed as simply as possible so that for the factor g few (for example 3) bits will be available. An important advantage with respect to the known apparatus is then that said digital multipliers may be of the same design (generally in the form of an integrated circuit) and can be adjusted for a multiplication factor which requires a small number of bits. The known apparatus, however, demands adjustments of the factors g and $(1-g^2)$, which generally prohibits the use of a few bits.

A calculation, identical to the one given above, can be carried out on the apparatus of FIG. 1 in which the gain factors of the delay lines 1 and 2 are not equal to each other and are non unity, say e.g. $G_1$ and $G_2$ respectively, and in which the gain factors of the feedback circuit 3 and the transfer circuit 4 are unequal as well, say e.g. $g_3$ and $g_4$ respectively. The following expressions are obtained:

$$S_4 = S_1 e^{-2j\omega\tau} G_1 G_2 \frac{1 + g_4/G_2 e^{j\omega\tau}}{1 - g_3 G_1 e^{-j\omega\tau}} \quad (3)$$

$$S_3 = S_1 e^{-j\omega\tau} G_1 \frac{1 + g_4/G_2 e^{j\omega\tau}}{1 - g_3 G_1 e^{-j\omega\tau}} \quad (4)$$

For an all-pass characteristic of the apparatus (flat frequency response) internally as well as externally, the following requirement should be met:

$$g_4/G_2 = -g_3 G_1 \quad (5)$$

of which $G_1 = G_2 = 1$ and $g_3 = -g_4$ is a special case. The stability criterion in the more general case, given by eqs. (3) to (5), must be that the loopgain $g_3G_1$ is smaller than unity.

It is to be understood that the circuit of FIG. 2 is not restricted to a series connection of a plurality of circuits according to FIG. 1, but the most general circuit of FIG. 2 is a series connection of a plurality of circuits satisfying eq. (5).

What is claimed is:

1. An artificial reverberation apparatus for audio frequency signals comprising, an input terminal, an adder having first, second and third inputs and an output, a delay device having an input coupled to the output of the adder and provided with a feedback circuit which couples an output of the delay device to the first input of the adder, the feedback gain factor of the feedback circuit being smaller than 1, a second delay device having the same delay time as the first delay device, means coupling the input terminal to the second input of the adder via said second delay device, and a transmission circuit coupling the input terminal to a third input of the adder, the transmission circuit having an equal but opposite transmission gain factor to that of said feedback gain factor.

2. A reverberation apparatus as claimed in claim 1 wherein the feedback circuit and the transmission circuit each comprise a digital multiplier.

3. An artificial reverberation apparatus for audio frequency signals comprising, an input terminal, a first delay device having an input and an output, a feedback circuit which couples the output of the delay device to the input thereof via a signal combining means to form a loop circuit having a loop signal gain of less than unity, a second delay device, having the same delay time as the first delay device, which couples said input terminal of the reverberation apparatus to the input of the first delay device via said signal combining means, a transmission circuit which couples said input terminal to the input of the first delay device via a current path that is exclusive of said second delay device and via said signal combining means, the ratio of the signal gain of the transmission circuit to the signal gain of said second delay device being equal to but of opposite sign to that of said loop signal gain.

4. An artificial reverberation apparatus as claimed in claim 3 wherein the signal gain of the transmission circuit is equal to but of opposite sign to the signal gain of the feedback circuit.

5. An artificial reverberation apparatus as claimed in claims 1, 2 or 4, wherein the signal gains of both delay devices are equal to unity.

6. An artificial reverberation apparatus as claimed in claims 3 or 4 wherein the feedback circuit and the transmission circuit each comprise a digital multiplier.

7. An artificial reverberation apparatus as claimed in claims 3 or 4, wherein the signal combining means comprises an adder circuit having first, second and third inputs and an output coupled to the input of the first delay device, outputs of the feedback circuit, the transmission circuit, and the second delay device being coupled to said first, second and third inputs of said adder circuit, respectively.

8. An artificial reverberation apparatus comprising first and second artificial reverberation apparatus each as claimed in claims 3 or 4 and connected in cascade and with the delay times of the delay devices of the first and second artificial reverberation apparatus being different.

* * * * *